US007107727B2

(12) United States Patent
Nelsen

(10) Patent No.: US 7,107,727 B2
(45) Date of Patent: Sep. 19, 2006

(54) PROTECTIVE BEAM AND JOIST CAP

(76) Inventor: Matthew James Nelsen, P.O. Box 503, Newberg, OR (US) 97132

( * ) Notice: Subject to any disclaimer, the term of this patent is extended or adjusted under 35 U.S.C. 154(b) by 196 days.

(21) Appl. No.: 10/411,000

(22) Filed: Apr. 10, 2003

(65) Prior Publication Data

US 2004/0200158 A1 Oct. 14, 2004

(51) Int. Cl.
*E04D 13/00* (2006.01)

(52) U.S. Cl. ..... 52/97; 52/731.7; 52/58; 52/716.2; 52/465; 52/300

(58) Field of Classification Search ..... 52/731.7, 52/731.1, 58, 97, 101, 716.2, 741.3, 465, 52/459, 300, 242, 483, 480, 169.5, 105, 410, 52/746, 301, 650.3; 256/59, 1, 32
See application file for complete search history.

(56) References Cited

U.S. PATENT DOCUMENTS

| | | | | | |
|---|---|---|---|---|---|
| 3,802,140 | A * | 4/1974 | Hickman | 52/300 |
| RE28,870 | E * | 6/1976 | Attaway et al. | 52/300 |
| 4,246,735 | A * | 1/1981 | Herzfeld | 52/465 |
| 4,322,924 | A * | 4/1982 | Cooper | 52/57 |
| 4,848,049 | A | 7/1989 | Hanson | |
| 4,858,399 | A | 8/1989 | Salato, Jr. | |
| 4,881,355 | A * | 11/1989 | Bosl et al. | 52/733.1 |
| 4,969,250 | A * | 11/1990 | Hickman et al. | 29/521 |
| 5,148,644 | A | 9/1992 | Weir | |
| 5,280,692 | A | 1/1994 | Patey | |
| 5,772,185 | A | 6/1998 | Pulsipher | |
| 5,887,394 | A * | 3/1999 | Workman | 52/301 |
| 6,434,908 | B1 * | 8/2002 | Ferrante | 52/731.7 |
| 6,449,911 | B1 | 9/2002 | Hudson | |
| 6,647,675 | B1 * | 11/2003 | Castellanos | 52/198 |

* cited by examiner

*Primary Examiner*—Daniel P. Stodola
*Assistant Examiner*—Nahid Amiri
(74) *Attorney, Agent, or Firm*—Starkweather & Associates; Michael W. Starkweather; Jason P. Webb

(57) ABSTRACT

A moisture barring device (10), forming a general T-shaped profile, designed for diverting air and ground born water away from, and protection of, a wood member (20), which is a beam or joist of an exterior wood structure. Additionally, there is a top (12), forming a longitudinal relatively horizontal strip with two parallel longitudinal edges. The top including a central strip section, extending along the central region of the top and positioned between the two longitudinal top edges. The top also having a pair of wing strips (32), extending along and coupled to either side of the central strip section respectively along a first wing edge, and each wing strip having a second wing edge that is coextensive with the two respective top edges. The top additionally having a drip edge (18), coupled along the respective second wing edge, forming an angle that is sloped downward with respect to the respective wing strip. The moisture barring device further including a pair of side panel strips (14). Each side panel having a top edge (30) that is coupled to the top where the wing strips is coupled to the central strip so as to extend relatively perpendicular downward from the top. The side panels also including a cavity (28), located between the pair of panel strips. Additionally, the side panels have a panel drip edge (16), coupled to a bottom edge (32) of the panel strips, forming an angle that is sloped outwardly from the cavity.

11 Claims, 4 Drawing Sheets

PROTECTIVE BEAM AND JOIST CAP

FIELD OF THE PREFERRED EMBODIMENT(S)

The preferred embodiment(s) relates to building construction materials generally. Specifically, there is a protective covering or cap for protecting beams and joists from moisture when used in constructing exterior wooden flooring, decking, and the like.

BACKGROUND OF THE PREFERRED EMBODIMENT(S)

There are many uses of wood for exterior applications. For example, structures such as decks, benches, handrails, tables, and chairs are often constructed of wood, or similar grade materials. In addition, roofs and overhangs in larger applications, are commonly built using wood.

Typical construction of quality deck flooring for outdoor applications requires use of redwood floor planks as deck surfacing. Redwood provides long term resistance to water damage, as well as an aesthetically appealing rustic appearance. Redwood, however, does not offer the degree of load bearing stiffness to provide good floor joist members. Consequently, fir or other more sturdy types of wood are selected for floor joists.

PROBLEMS WITH PRIOR ART

Although conventional wood floor joist members supply the required load bearing capacity, they are typically subject to water damage and will necessitate replacement long before the deck flooring is worn. Unfortunately, replacement of the floor joists generally results in removal of the redwood floor planks, often leading to damage that makes floor decking unsalvageable. Repair of supporting joists, therefore, is often tantamount to replacement of floor decking as well. This problem has long been recognized, leading to various plastic devices for shielding water away from floor joists, particularly under decking surfaces.

Woodrot can be a major problem for many exterior wood applications. Especially for applications that require joining wood members together that are exposed to the elements, the problem of moisture induced deterioration can be aesthetically and structurally devastating. Points of joinery naturally retain water and thereby facilitate the deterioration process.

In an effort to mitigate the problems associated with moisture induced woodrot, several methods for diverting water from wood grade materials have been contemplated. However, all previous conceptions have failed to address both air and ground borne sources of moisture. All of the prior art are aimed at generally protecting wood members from air borne precipitation/moisture only and not moisture drops formed all over the structure.

The following patents are herein incorporated by reference, for the supporting teachings:

(a) U.S. Pat. No. 5,280,692 issued to Patey, describes a water shield, reinforcing device for insertion over a top edge of a joist member which is useful for supporting a wood deck or other outdoor structure which may be exposed to water.

(b) U.S. Pat. No. 5,772,185 issued to Pulsipher, describes a protective cap for covering a top of a wall which has the form of an elongate channel having an upper plate and opposing side walls.

(c) U.S. Pat. No. 5,148,644 issued to Weir, describes a protective covering strip of flexible, waterproof material which is configured to fit over the upper and/or side surfaces of an elongated wooden member.

(d) U.S. Pat. No. 4,858,399 issued to Salato Jr., describing a channel shaped strip formed of a resilient material that is press-fitted over the beams of a deck to protect the beams from water damage and the like.

It is believed that all of the listed patents do not anticipate or make obvious the disclosed preferred embodiment(s). In view of the prior art deficiencies, there is a need for an invention that incorporates the use of a cap and a lower section with protective panels. The invention would serve to protect wood members (such as beams or joists) against potentially damaging air (rain) and ground (dew or fog) moisture at the joint between joining wood members (such as decking or framing material).

SUMMERY OF ILLUSTRATED EMBODIMENTS

The invention relates generally to building construction materials generally. Specifically, there is a protective covering or cap for protecting beams and joists from both air (rain) and ground (dew or fog) moisture when used in constructing exterior wooden flooring, decking, and the like.

Additionally, the inventions serves to protect wood members (such as beams or joists) against potentially damaging air (rain) and ground (dew or fog) moisture at the joint between joining wood members (such as decking or framing material).

The invention includes a moisture barring device (10), forming a general T-shaped profile, designed for diverting air and ground born water away from, and protection of, a wood member (20), which is a beam or joist of an exterior wood structure. Additionally, there is a top (12), forming a longitudinal relatively horizontal strip with two parallel longitudinal edges. The top including a central strip section, extending along the central region of the top and positioned between the two longitudinal top edges. The top also having a pair of wing strips (32), extending along and coupled to either side of the central strip section respectively along a first wing edge, and each wing strip having a second wing edge that is coextensive with the two respective top edges. The top additionally having a drip edge (18), coupled along the respective second wing edge, forming an angle that is sloped downward with respect to the respective wing strip. The moisture barring device further including a pair of side panel strips (14). Each side panel having a top edge (30) that is coupled to the top where the wing strips is coupled to the central strip so as to extend relatively perpendicular downward from the top. The side panels also including a cavity (28), located between the pair of panel strips. Additionally, the side panels have a panel drip edge (16), coupled to a bottom edge (32) of the panel strips, forming an angle that is sloped outwardly from the cavity.

Additional features and advantages of the invention will be set forth in the detailed description which follows, taken in conjunction with the accompanying drawings, which together illustrate by way of example, the features of the invention.

BRIEF DESCRIPTION OF THE DRAWINGS

The prior features of the summary of the illustrated embodiment(s) will become more evident upon examination of the following detailed description in conjunction with the following figures, where similar element numbers represent similar elements in the figures.

DETAILED DESCRIPTION OF THE ILLUSTRATED EMBODIMENT(S)

Figure 1:
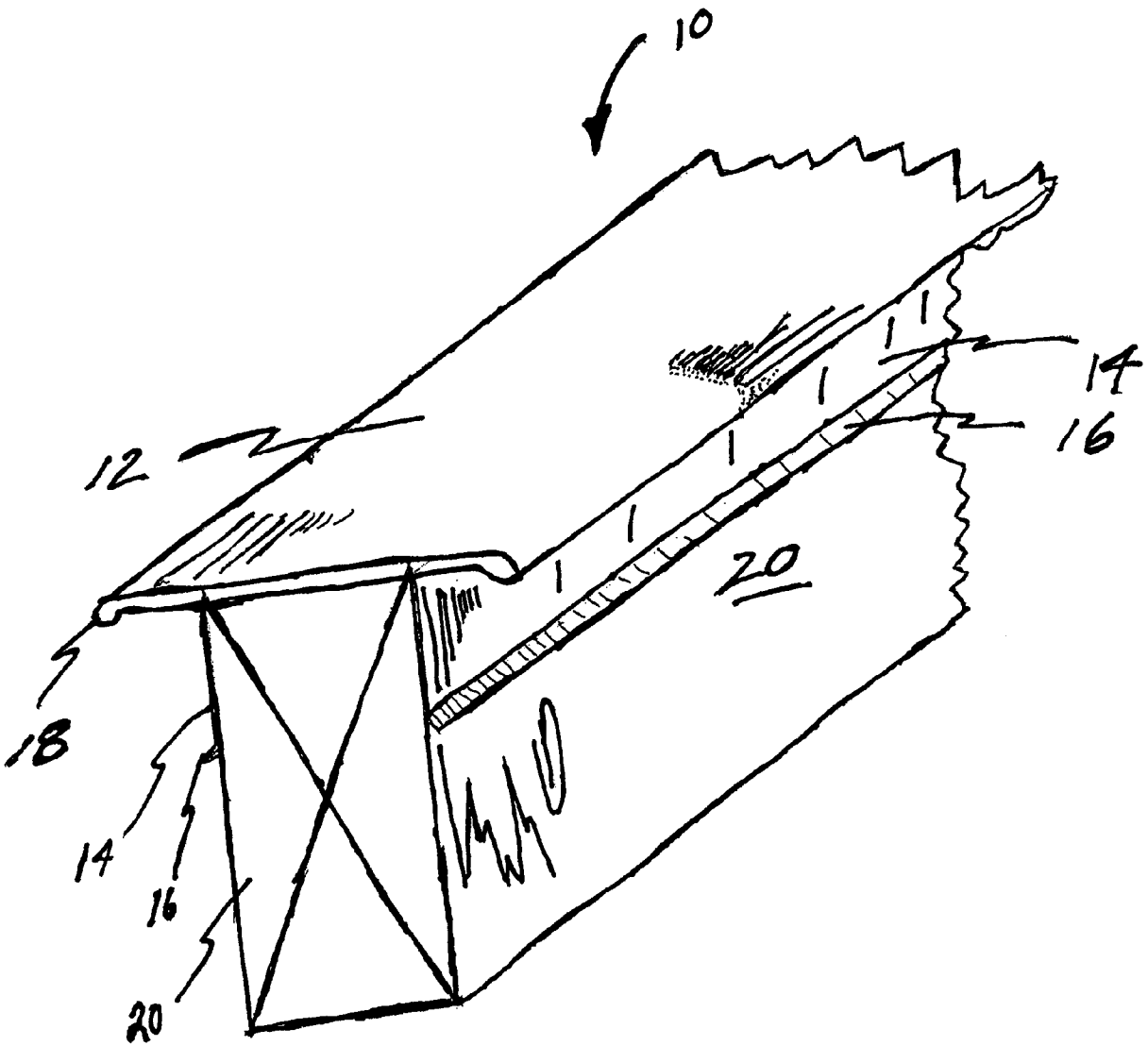
FIG. 1 illustrates a section of a protective beam and joist cap in an isometric view.

For the purpose of promoting an understanding of some of the principles of the illustrated embodiment(s), reference will now be made to exemplary embodiment(s) that are illustrated in the figures, and specific language will be used to describe the same. It will nevertheless be understood that no limitation of the scope of the claims is thereby intended. Any alterations and further modifications of the inventive features illustrated herein, and any additional applications of these principles, which would be considered within the scope of this invention.

The present invention generally relates to a system and method of providing a protective covering or cap for protecting beams and joists from both air (rain) and ground (dew or fog) moisture when used in constructing exterior wooden flooring, decking, and the like. Specifically, referring to FIG. 1, there is illustrated a section of a protective beam and joist cap 10, herein referred to as a cap 10, in an isometric view showing the cap positioned over a wood member 20 of variable dimensions. Additionally, there is a top 12, forming a longitudinal strip shape, which is designed to generally support the mounting of decking material on top of it, and to divert moisture away from the wood member 20, which method will be discussed later. There is also a pair of side panels 14, forming perpendicular strips from the top 12, which are designed to fit tightly over both sides of the wood member 20 as illustrated, and to protect against moisture from the air and ground intrusion.

The cap 10 also has a drip edge, or panel drip edge 16 that is coupled to a bottom edge of both side panels 14. The edges 16 are shaped to allow for condensed water or other precipitation to collect on the side panel 14 and drip off of the drip edge 16. Most importantly, this edge 16 has the effect of causing the water to fall a certain distance away from the sides of wood member 20; thus, preventing any contact therebetween. The angled edge 16 also facilitates the installation of the Beam and Joist Cap 10 over the wood member 20. Specifically, the edge 16 allows for minor variations in the width of the variable dimension wood members 20, allowing the wood to slide easily between the two side panels 14.

Both sides of the top 12 has its own drip edge, or top drip edge 18, which is shaped to allow for precipitation or condensation to collect o the top surface of the top 12 and to drip off of the drip edges 18. As expected, the edges 18 cause the water to fall to the ground in a location that is a sufficient distance away from sides of the wood member 20.

It is noted that wood member 20 can be any wood framing material that requires this type of moisture protection, including joists or beams for example.

Figure 2:
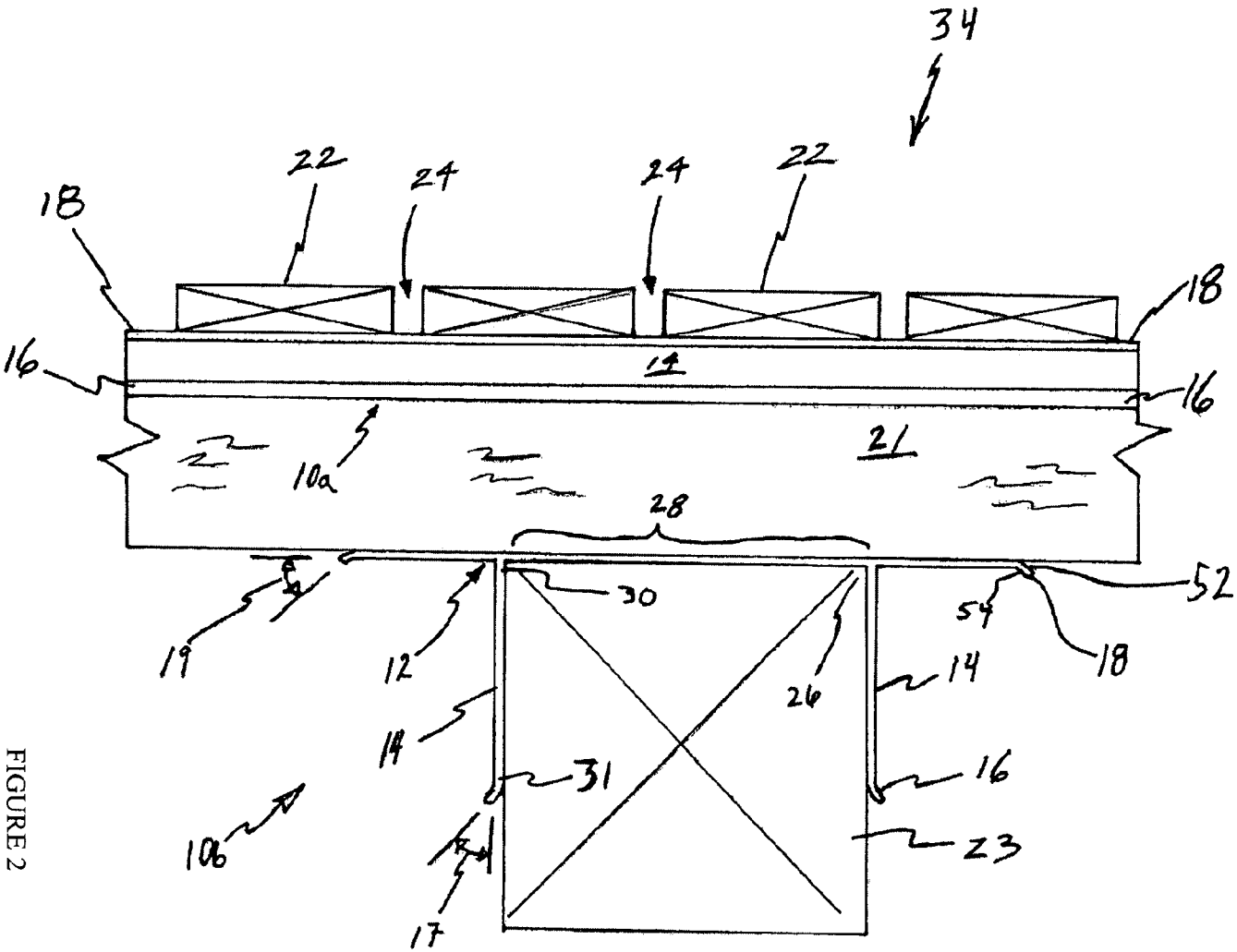
FIG. 2 illustrates an end view of the lower protective beam and joist cap of FIG. 1 and a side view of an upper protective beam and joist cap of FIG. 1 as employed in construction of a double stacked exterior wood deck structure.

Referring now to FIG. 2, there is an end, or cross sectional, view of the lower protective beam 23, and a side view of an upper protective joist 21 as employed in construction of a double stacked exterior wood deck structure 34. Uniquely, in addition to those elements already introduced in FIG. 1, it is pointed out that all drip edges 16 and 18 are specifically designed to have angles 17 and 19 that range from 1–90 degrees from the respective attached major surfaces as illustrated. Specifically, angle 19 is formed or bent downward from the top surface of top 12, thereby forming downward angled tips having both the top 52 and bottom 54 surfaces angled downward and substantially parallel to each other, and angle 17 extends outward from vertically oriented side panels 14, thereby forming outwardly angled tips having both the inner and outer surfaces angled outward from the interface with the wood member and substantially parallel to each other.

FIG. 2 also shows a cross-sectional view of decking material 22 as installed over a joist 21 with cap 10*a* placed therebetween. Joist 21 is mounted over beam 23 also with cap 10*b* that is mounted therebetween. It is important to note that this arrangement is a common construction design. Additionally, note that there are moisture drainage gaps 24 formed between decking material 22. The moisture drainage area 24 allows the majority of moisture to collect and drip off through this area, i.e. between the individual decking materials 22. It is also noted that cap 10*a* is positioned over or above cap 10*b*. As a result of having the drainage gap 24 and cap 10*a* arranged in this construction arrangement or structure, it is important to also install cap 10*b* to prevent beam 23 from being exposed to excess moisture originating from gaps 24 and cap 10*a*.

FIG. 2 also illustrates a top edge 26 of beam 23, which is in contact with the top 12. Additionally, there is shown that there is a cavity 28, which will vary in size according to the dimensions needed to fit over the specific beam of wood 23. Also illustrated are first and second ends 31 of side panels 14.

Figure 3:
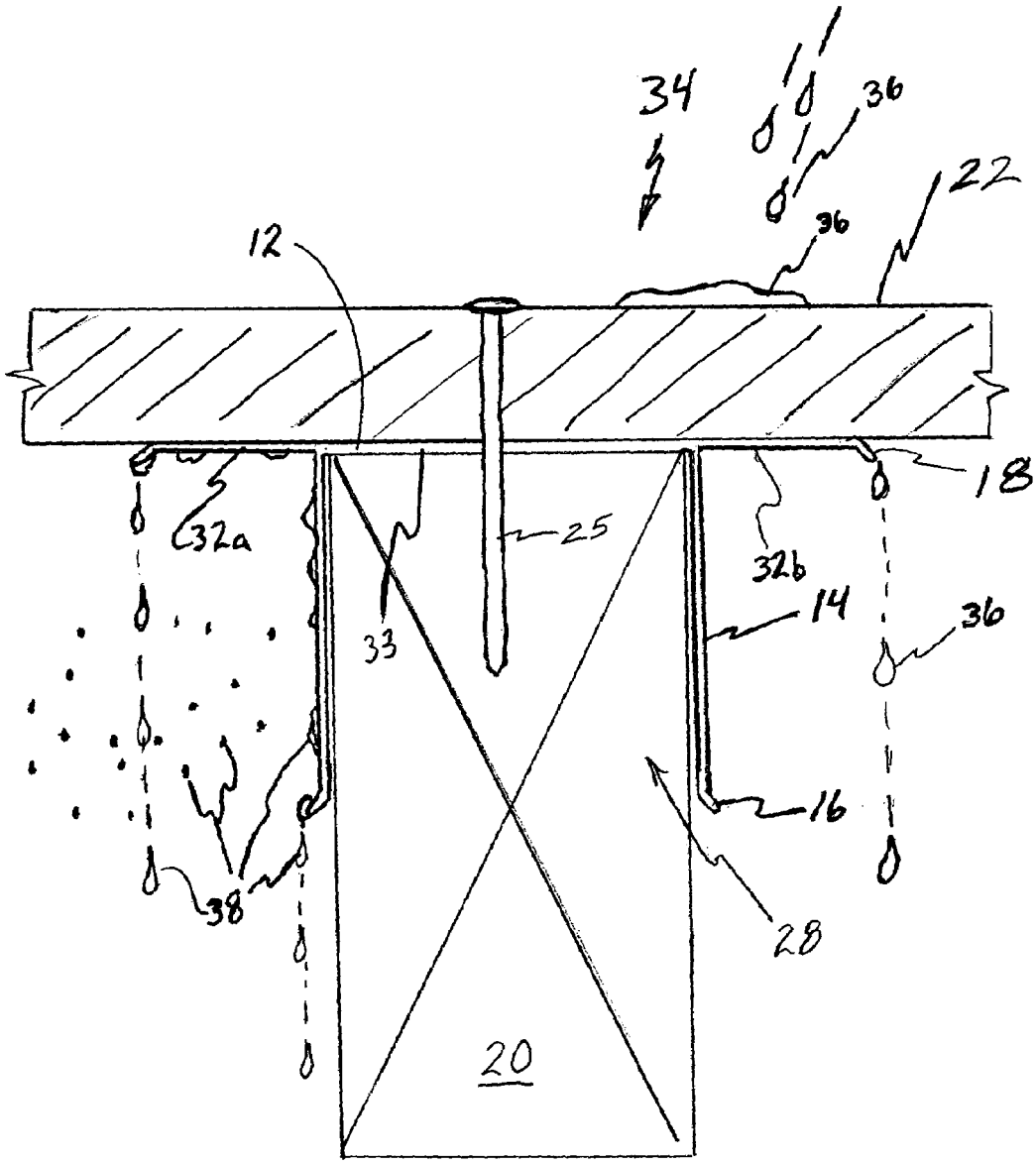
FIG. 3 illustrates a side view of the protective beam and joist cap of FIG. 1 as employed in another type of exterior wood deck structure.

FIG. 3 a side view of the protective cap 10 of FIG. 1 as employed in another type of exterior wood deck structure 34. Specifically, there is decking material or board 22 mounted over beam 20 having cap 10 positioned over beam 20 and in contact with a lower surface of board 20. Fastening device 25 may be in the form of a nail, as illustrated, or as screws or other wood penetrating and holding device.

Uniquely illustrated are wings 32*a* and 32*b*. Wings 32*a* and 32*b* are specific portions of the top 12 and extend from the outer drip edges 18 to a location next to where side panels 14 come in contact with the top 12. One skilled in the art will easily understand that it would be a natural equivalent to have wings 32*a* and *b* to incorporate a downward slope toward the edges 18 for the purpose of facilitating the dripping action. Additionally, there is a central strip section 33, which extends completely between the two intersections where the wings 32*a* and *b* contact the two respective side panels 14. Therefore, it is noted that top 12 is made up of three sections, namely, a central strip section 33, that is banded on either side by the two wing strips 32*a* and *b*, and the two longitudinal drip edges 18.

Figure 4:
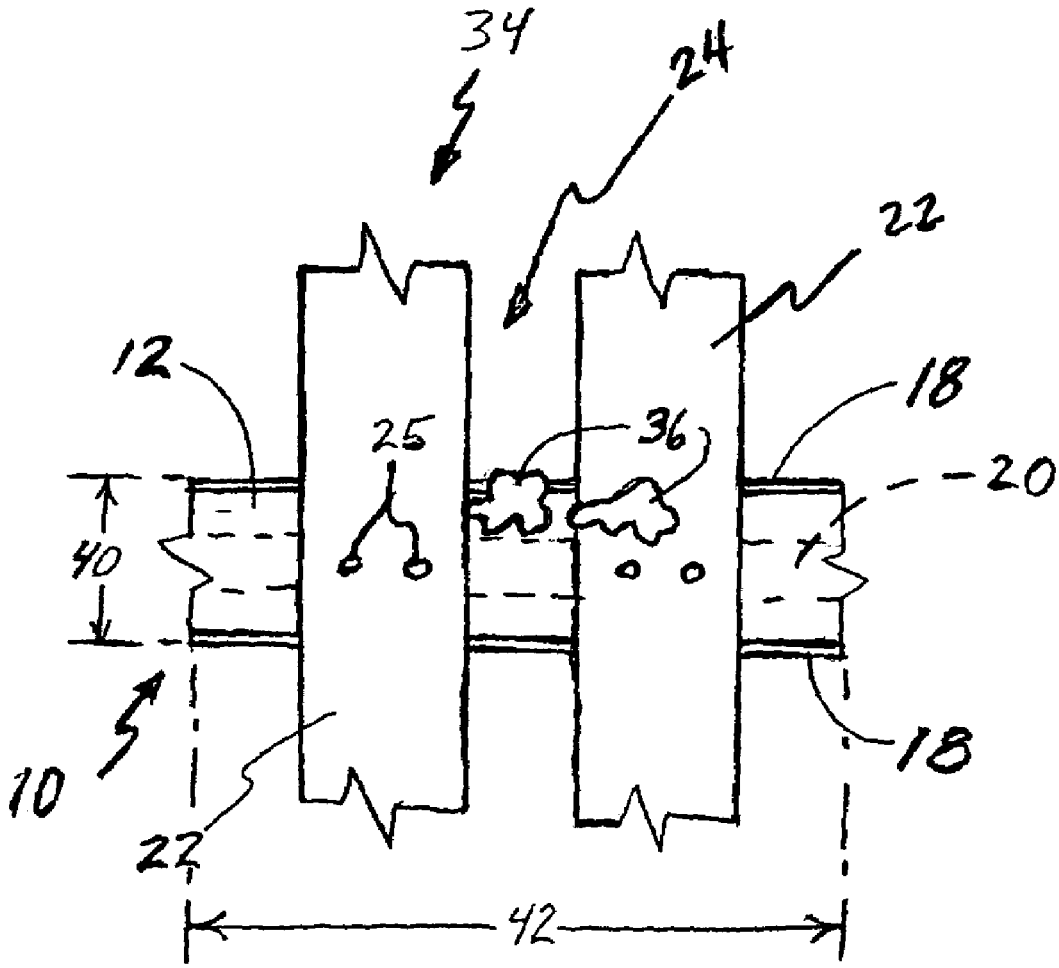
FIG. 4 illustrates a top view of the protective beam and joist cap of FIG. 1 as employed in another type of exterior wood deck structure.

FIGS. 3 and 4 illustrate what happens to air and ground based moisture that accumulates on the construction structures. Uniquely, air born moisture, i.e. rain water 36, impacts board 22, accumulates on the top surface of the boards 22, drips down between gaps 24, which is illustrated in FIG. 2, and contacts top 12, where it is wicked toward drip edge 18 and drips to the ground without contacting beam 20. Similarly, ground emanating moisture (also referred to as fog or dew 38) will collect on the exposed surfaces of the cap 10 (i.e. under 32*a* and outside surface of wall 14) where the moisture 38 will pool up and begin dripping down to the drip edges 16 and 18 down to the ground without contacting the surfaces of beam 20 as illustrated in FIG. 3.

FIG. 4 additionally illustrates the rectangular or longitudinal strip formation of the top 12. Specifically, there is a width 40 that is much smaller than the length 42.

Remarks About the Illustrated Embodiment(s)

Uniquely, the present invention 10 shows a method and device for protecting wood members 20 against moisture. The present invention anticipates the dangers of both air borne precipitation and ground borne condensation. The protective functions are performed by diverting precipitation away from the body of the wood member 20 through the use of a cap 10, comprised of a single piece of approximately T-shaped water-resistant material. The illustrated embodiments teach a method for allowing condensation to be diverted away from the wood member 20 through the use of side panels 14 originating as continuous pieces of material extending vertically downward and away from the top 12. Both the top 12 and side panels 14 maintain drip edges 18 and 16 respectively, which effectively direct moisture away from direct contact with the wood 20. The uniqueness of this invention is found in its ability to protect wood from moisture damage originating from both potential moisture sources. It is noted that one skilled in the art would notice that a plastic cap would keep moisture from the wood where the nail is protruding through the cap to hold it in place. This is because the plastic is deformed where the nail is location and will further seal tightly against the nail.

Variations of the Invention

It is noted that in a skilled artisan would understand that there are many potential materials available for use in an application for capping and protecting wood, particularly in areas of wood joinery. For example, rubber, plastic, elastomeric material, or even a rust proof metal such as aluminum, would accomplish the intended purpose of preventing moisture accumulation in wood and thereby help prevent the problem of wood rot. Furthermore, considerable variations on the width of the top cap (up to 3 inches wider than the contact surface of the joist or beam) and length of the side panels (up to the full height of the joist or beam) are contemplated. Finally, the angle and length of the drip edges for both the top 12 and side panels or walls 14 may be increased or decreased according to the dimensions of the wood, severity of precipitation, and/or the severity of condensation (dew).

Even though the present illustrations show the side panels 14 to extend only part of the way down the side of the beam 20, it is contemplated to have the panels extend any length, even to extend the whole length of the beam to protect it from excessive moisture.

Ultimately, while the invention has been described in connection with a preferred embodiment, the description provided herein is not intended to limit the scope of the invention to the particular embodiment(s) set forth, but, on the contrary, is intended to cover such alternatives, modifications, and equivalents as may be included within the spirit and scope of the invention as defined by the appended claims.

The invention claimed is:

1. A moisture barring device forming a general T-shape, for diverting air and ground born water away from a beam of an exterior wood structure, comprising:

a top, forming a longitudinal relatively horizontal strip configured to divert moisture away from the beam, wherein the top includes:

a central strip section, extending longitudinally and configured to cover the top of the beam;

a pair of wing strip sections, extending longitudinally and coextensive with the central strip section, wherein each wing strip section is configured to divert moisture away from the beam;

a pair of top drip edges, each extending longitudinally and coextensive with one of the pair of wing strip sections, wherein both top and bottom surfaces of each top drip edge extends away from one of the pair of wing strip sections at an acute angle;

a pair of side panel strips coupled to the central strip section and extending longitudinally and extending generally perpendicularly downward thereby forming a cavity; and a pair of panel drip edges, each extending longitudinally and coextensive with one of the pair of side panel strips, wherein both interior and exterior surfaces of each panel drip edge extends away from one of the pair of side panel strips acutely.

2. The device of claim 1, wherein the top forms a tight seal around a fastening device when punctured thereby.

3. The device of claim 1, wherein each of the wing strip section;

extends from a corresponding junction of the side panel strips and the center strip section.

4. A moisture barrier device for hindering moisture exposure to a wood member, comprising:

a top, forming a strip, having:

a central strip section configured to extend over a wood member; and a top drip edge, directly attached to opposite and parallel sides of the central strip section, having top and bottom surfaces that are each extending downward and laterally from the central strip section at an acute angle; and a first and second side panel, forming a cavity therebetween and shaped to allow the wood member to be inserted therein, each of the first and second side panels coupled to and extending substantially perpendicularly downward from the top, each of the first and second side panels having:

an inner surface and an outer surface, wherein the inner surface borders the cavity;

a first end coupled to the top;

a second end positioned opposite the first end; and a panel drip edge having inner and outer surfaces extending at a drip edge angle from the second end so that each of the inner and outer surfaces of the panel drip edge are acutely angled outward from the cavity, and the outer surface of the panel drip edge does not extend outward of the top drip edge.

5. The device of claim 4, wherein the top forms a tight seal around a fastening device when punctured thereby.

6. The device of claim 4, wherein the top wing strip sections each extend from a corresponding junction of the first and second side panels and the top.

7. A single, contiguous, and generally T-shaped moisture barring device for diverting water away from and protecting a wood member, consisting of:

a top, configured to cover and extend wider than a width of the wood member, the top comprising a central strip section, a pair of the wing strip section and downward angled tips having a top and bottom surfaces, wherein both the top and bottom surfaces are substantially parallel and acutely angled downward; and two side panels, extending substantially perpendicularly down from the top to extend along sides of the wood member, and each of the side panels includes a drip edge at an end of each of the side panels formed by outwardly angled tips having an inner and outer surface that are substantially parallel and both acutely angled outward from the sides of the wood member, and extending outwardly no more than the downward angled tips of the top.

8. The device of claim 7, wherein the top forms a tight seal around a fastening device when punctured thereby.

9. The device of claim 7, wherein the downward angled tips extend from the wing strip sections wherein the wing strip sections extends outwardly from a junction of the side panels and the central strip section.

10. The device of claim 1, wherein the top and bottom surfaces of each top drip edge are substantially parallel.

11. The device of claim 4, wherein the top and bottom surfaces of each top drip edge are substantially parallel.

* * * * *

UNITED STATES PATENT AND TRADEMARK OFFICE

CERTIFICATE OF CORRECTION

PATENT NO. : 7,107,727 B2
APPLICATION NO. : 10/411000
DATED : September 19, 2006
INVENTOR(S) : Matthew James Nelsen It is certified that error appears in the above-identified patent and that said Letters Patent is hereby corrected as shown below:

Column 1, Line 25 - “howerver” should be --however--

Column 4, Line 10 - “o” should be --on--

Signed and Sealed this

Tenth Day of April, 2007

JON W. DUDAS
*Director of the United States Patent and Trademark Office*